US011781198B2

(12) United States Patent
Ebner et al.

(10) Patent No.: US 11,781,198 B2
(45) Date of Patent: Oct. 10, 2023

(54) TEMPERATURE CONTROL DEVICE FOR THE TEMPERATURE CONTROL OF A COMPONENT

(71) Applicant: EBNER INDUSTRIEOFENBAU GMBH, Leonding (AT)

(72) Inventors: Robert Ebner, Leonding (AT); Peter Seemann, Asten (AT); Andreas Sauschlager, Leonding (AT)

(73) Assignee: Ebner Industrieofenbau GmbH, Leonding (AT)

( * ) Notice: Subject to any disclaimer, the term of this patent is extended or adjusted under 35 U.S.C. 154(b) by 269 days.

(21) Appl. No.: 16/466,620

(22) PCT Filed: Dec. 7, 2016

(86) PCT No.: PCT/EP2016/080126
§ 371 (c)(1),
(2) Date: Jun. 4, 2019

(87) PCT Pub. No.: WO2018/103841
PCT Pub. Date: Jun. 14, 2018

(65) Prior Publication Data

US 2019/0323106 A1 Oct. 24, 2019

(51) Int. Cl.
*C21D 9/48* (2006.01)
*C21D 1/34* (2006.01)
*C21D 9/00* (2006.01)

(52) U.S. Cl.
CPC ..... *C21D 9/48* (2013.01); *C21D 1/34* (2013.01); *C21D 9/0025* (2013.01); *C21D 9/0056* (2013.01)

(58) Field of Classification Search
CPC ..... C21D 9/48; C21D 1/34; C21D 9/0025; C21D 9/0056
See application file for complete search history.

(56) References Cited

U.S. PATENT DOCUMENTS 4,440,584 A 4/1984 Takeshige et al.
6,174,389 B1 * 1/2001 Mann ..... C21D 1/667 148/640

(Continued)

FOREIGN PATENT DOCUMENTS

CN 1043891 A 7/1990
CN 1805803 A 7/2006

(Continued)

OTHER PUBLICATIONS

Machine Translation of WO-2013189597-A1 (Year: 2013).*

(Continued)

*Primary Examiner* — Kevin E Yoon
*Assistant Examiner* — Ryan L Heckman
(74) *Attorney, Agent, or Firm* — Lewis Roca Rothgerber Christie LLP

(57) ABSTRACT

The invention relates to a device for temperature-controlling a component part. The device has a temperature-control zone, along which the component part is movable along a conveying direction. The temperature-control zone is configured to temperature-control at least one temperature-control section of the component part. Furthermore, the device has a temperature-control zone controller, which is configured to cover a covering region of the temperature-control zone such that in the covering region a temperature-control effect from the temperature-control zone on the temperature-control section of the component part is reducible. Herein, the temperature-control zone controller is configured so as to adjust the size of the covering region.

13 Claims, 2 Drawing Sheets

(56) References Cited

U.S. PATENT DOCUMENTS

| | | | | |
|---|---|---|---|---|
| 2009/0320968 | A1 | 12/2009 | Boeke et al. | |
| 2012/0297849 | A1 | 11/2012 | Berchem et al. | |
| 2014/0045130 | A1 | 2/2014 | Eckertsberger et al. | |
| 2014/0367898 | A1* | 12/2014 | Hebert | C21D 1/56 266/44 |
| 2015/0017593 | A1* | 1/2015 | Yoko | F04D 29/023 432/9 |
| 2015/0377556 | A1 | 12/2015 | Ishiguro | |
| 2016/0348201 | A1* | 12/2016 | Grausgruber | C21D 1/09 |

FOREIGN PATENT DOCUMENTS

| | | | | |
|---|---|---|---|---|
| CN | 102655959 | A | 9/2012 | |
| DE | 10 2006 018 406 | A1 | 9/2007 | |
| DE | 102007012180 | B3 | 6/2008 | |
| DE | 102009023195 | A1 | 12/2010 | |
| DE | 102012102193 | A1 * | 9/2013 | C21D 1/34 |
| DE | 102012102194 | A1 | 9/2013 | |
| DE | 102012016075 | A1 | 12/2013 | |
| EP | 1 634 657 | A1 | 3/2006 | |
| EP | 2 143 808 | A1 | 1/2010 | |
| EP | 2264193 | A1 | 12/2010 | |
| EP | 2 322 672 | A1 | 5/2011 | |
| EP | 2548975 | A1 | 1/2013 | |
| EP | 2639536 | B1 | 5/2019 | |
| KR | 100518760 | B1 * | 10/2005 | C21D 1/00 |
| WO | WO 2013/000001 | A1 | 1/2013 | |
| WO | 2013189597 | A1 | 12/2013 | |
| WO | WO 2013/189597 | A1 | 12/2013 | |
| WO | WO-2013189597 | A1 * | 12/2013 | C21D 1/70 |

OTHER PUBLICATIONS

Machine Translation of DE-102012102193-A1 (Year: 2013).*
Alternate Translation of Paragraph [0028] of DE-102012102193-A1 (Year: 2013).*
Machine Translation of KR100518760B1 (Year: 2005).*
International Search Report and Written Opinion of corresponding PCT/EP2016/080126, dated Sep. 7, 2017, 16 pages.

* cited by examiner

TEMPERATURE CONTROL DEVICE FOR THE TEMPERATURE CONTROL OF A COMPONENT

CROSS-REFERENCE TO RELATED APPLICATIONS

The present application is a national phase application derived from the international patent application no. PCT/EP2016/080126, filed Dec. 7, 2016, which is incorporated herein by reference in its entirety.

TECHNICAL AREA

The invention relates to a device for temperature-controlling a component part as well as a method for temperature-controlling a component part.

BACKGROUND OF THE INVENTION

In modern metal processing, in particular for metal materials for carriage components in automotive engineering, component parts are requested, which have defined regions with exactly adjusted ductility and brittleness properties. In this respect, for example, B-pillars of a vehicle are manufactured from one component part, wherein the component part and/or the B-pillar itself has regions of different ductility.

The adjustment of a metal component part having regions of different ductility is enabled in particular by a precise adjustment of the temperature courses during the hardening and tempering and/or manufacture of the component parts, such that thereby the desired texture stages (or steps) of a component part can be adjusted in predefined regions.

In particular for longer continuous furnaces, a precise temperature-control profile of the component part to be manufactured within the continuous furnace is complex and is difficult due to the dynamic displacement of the component part during its manufacture.

PRESENTATION OF THE INVENTION

There may be a need to provide a device for better adjusting a temperature-control effect on a component part to be manufactured.

According to the present invention, there is provided a device for temperature-controlling a component part as well as a method for temperature-controlling a component part according to the objects of the independent claims.

According to a first embodiment aspect of the invention, there is described a device for temperature-controlling (or for the temperature-control of) a component part. The device has a temperature-control zone, along which the component part is movable along a conveying direction. The temperature-control zone is configured to temperature-control at least one temperature-control section of the component part. Furthermore, the device has a temperature-control zone controller, which is configured to cover a covering region of the temperature-control zone such that in the covering region a temperature-control effect from the temperature-control zone to the temperature-control section of the component part is reducible. Herein, the temperature-control zone controller is configured so as to adjust the size of the covering region.

According to a further embodiment aspect of the invention, there is described a method for temperature-controlling a component part. According to the method, the component part is moved along a temperature-control zone. The temperature-control zone is configured to temperature-control at least one temperature-control section of the component part. Furthermore, a covering region of the temperature-control zone is covered with a temperature-control zone controller such that in the covering region a temperature-control effect of the temperature-control zone on the temperature-control section of the component part is reducible. Furthermore, the size of the covering region is adjusted by the temperature-control zone controller.

The device for temperature-controlling (heating or cooling) of a component part may heat or cool in particular the component part. For example, the device according to the invention may represent a high-speed (or high-rate) cooler, which may find application in hardening and/or annealing (or quenching and tempering) lines as well as in CALs (Continuous Annealing Lines) and CGLs (Continuous Galvanizing Lines). In particular, in the modern metal processing technology it may be necessary that metallic component parts are exposed during their manufacturing to a precise heating and/or cooling progression during their manufacturing, such that a desired material structure (or microstructure) and according desired material properties may be reached at predetermined sections of a component part.

The component part, which may be temperature-controlled by the device according to the invention, may in particular be a metallic component part. The component part may represent for example an iron-sheeting piece. For example, the component part may represent a pre-formed metal piece. In a preferred embodiment, the component part may be a belt, in particular a metal belt, which may run through the temperature-control device along a conveying direction. Thus, for example, the component part may initially be conveyed along an oven device, in particular through a continuous furnace (or through-type furnace). Following the oven device, for example, the device according to the invention for temperature-controlling may be arranged and may function for example as a high-speed cooler as described above.

The device according to the invention may herein be formed according to the type of a continuous device (or tunnel machine), such that the component part may run through the device in the conveying direction with a predetermined velocity. Along the running-through through the device, the component part may be cooled with a predefined cooling rate (or heated with a predefined heating rate). The device may have for example a housing, which may have, in the conveying direction, an entrance and an exit, such that the component part can be guided through the device. Within the device, for example temperature-control devices and/or temperature-control elements may be arranged, which may temperature-control the component part with a desired temperature. Herein, the temperature-control elements may represent for example nozzles, as is described further below, which may be flown through by a temperature-control fluid. Furthermore, the temperature-control elements may also be electrical temperature-control elements, such as for example electrical heaters, or temperature-control pipes, through which an according hot or cold temperature-control fluid may flow.

The area within the device, in which the component part may be temperature-controlled, may be referred to as the temperature-control zone. The component part may be moved along the temperature-control zone in the conveying direction. Herein, the component part may be moved continuously or sequentially along the conveying direction through the temperature-control zone. The temperature-control zone of the device may be configured such that at least a temperature-control section of the component part may be temperature-controlled. The component part may be for example smaller than the temperature-control zone, such that the temperature-control zone may cover the whole area of the component part. In the case, in which the component part may be larger than the temperature-control zone, for example because the component part may represent a metal belt, the temperature-control zone may cover respectively only a section (or region) of the component part.

The temperature-control zone may be configured in particular such that along the whole area thereof a thermal effect, i.e. thermal energy or a cooling effect, may affect the component part. In other words, temperature-control elements may be conceived along the whole temperature-control zone, which elements may transfer the desired thermal effect on the component part.

According to the present invention, a temperature-control zone controller may be employed, which may cover a covering region of the temperature-control zone. For example, the whole temperature-control zone may be covered by the temperature-control zone controller, or no region of the temperature-control zone may be covered in an in particular inactive state of the temperature-control zone controller. The covering of the temperature-control zone may be embodied for example with the elements, such as for example a covering device, covering flaps or covering lamellae, which are described in detail further below. In an embodiment example, also a combination of the enumerated elements for covering may be combined in one and the same device. The covering may be effected in particular between the temperature-control elements within the temperature-control zone on the one hand and the component part itself on the other hand. Thus, in other words, the temperature-control zone controller can cover a region of the temperature-control zone, such that the thermal effect, which is directed from the temperature-control zone on the component part, may be covered and/or reduced. In this covering region of the temperature-control zone, the component part may thus be not and/or reducibly temperature-controlled. To this end, the temperature-control zone controller may further have in particular a control unit, for example a processor-controlled unit (for example, a computer).

Since the temperature-control zone controller may adjust flexibly the covering region and/or the covering of the temperature-control zone, a temperature-control of the component part and/or an adjustment of the temperature-control section of the component part may accordingly be implemented variably and precisely. If for example a section of the component part, which shall be cooled (and/or heated) strongly, runs through the temperature-control zone, then the covering of the temperature-control zone may be reduced and/or the covering region is made smaller. On the contrary, if another section of the component part, which shall not and/or hardly be cooled (and/or heated), runs through the temperature-control zone, then the covering of the temperature-control zone may be increased and/or the covering region may be enlarged. Thus, a reduced temperature-control effect may act on the component part. Thus, an effective and robust temperature-control device, in particular a high-speed cooler, the temperature-control effect of which may be precisely adjustable, may be established by the present invention. Due to the possibility to cover variably parts of the high-speed cooler and/or of the temperature-control zone, the final quenching temperature may be defined. The cooling power and/or the heating power of the device (e.g. a blower for a temperature-control fluid) may stay constant herein, and nevertheless a precise and flexible temperature-control effect on the component part may be adjusted by the covering.

According to an exemplary embodiment of the invention, the temperature-control zone that has been described already above may have, along the conveying direction, a plurality of temperature-control elements that may be spaced at a distance to each other.

According to a further exemplary embodiment, the temperature-control zone may have, transverse to the conveying direction, a plurality of temperature-control elements, which may be spaced at a distance. The temperature-control elements may be arranged along a row parallel to the conveying direction or transverse to the conveying direction. In particular, a matrix consisting of rows of temperature-control elements transversely (or traverse) and along the conveying direction may form the temperature-control zone.

According to a further exemplary embodiment, the temperature-control elements may be nozzles, through which a temperature-control fluid may be flowable in the direction towards the temperature control section of the component part. The temperature-control fluid may be for example gaseous or liquid. For example, the temperature-control fluid may have air or a particular inert gas, wherein the temperature-control fluid may have a predetermined temperature. Furthermore, the temperature-control fluid may have a liquid, such as for example water or an oil-containing liquid. Furthermore, the temperature-control fluid may have for example water vapour or another vaporous element.

According to a further exemplary embodiment, the temperature-control zone controller may have a covering device, wherein the covering device may be displaceable along the conveying direction and/or transverse to the conveying direction, in particular with respect to the temperature-control zone. In an exemplary embodiment, the covering device may be a fabric (or cloth) material or a sheet plate (or iron-sheeting) material. As is described at the beginning, the covering device may be adjustable, at a housing of the device, between the component part and the temperature-control zone, such that a particular region of the temperature-control zone may be coverable, and thus a temperature-control effect from the temperature-control zone on the component part may be reducible and/or adjustable. The covering device itself may for example be formed of a temperature-insulating material. Thus, the covering device may consist for example of a metal plate and/or a metal iron sheeting. On the metal plate and/or the metal iron sheeting, temperature-insulating layers may be applied. Furthermore, an active temperature-control device may be integrated in the covering device itself. Thus, the covering device may have itself for example a water cooling and/or a water heating, in order to block and/or diminish increasedly the temperature-control effect from the temperature-control zone on the component part. If the device is used for example as a high-power cooler, then the covering device may have for example itself electrical heating elements in order to actively reduce the cooling effect.

The further the covering device may be moved into the temperature-control zone, i.e. the more of the nozzle array may be covered, the less far the belt (component part) may be cooled down.

Furthermore, the covering device may be formed of a flexible and/or deformable, thermally insulating webbing.

According to a further exemplary embodiment, the covering device may rest on at least one guide roller. The guide roller may be drivable for example as a part of the temperature-control zone controller, in order to move the covering device targetedly to a desired position along the temperature-control zone. The guide roller may be operated for example by a controlled electric servomotor.

In a further exemplary embodiment, the covering device may be formed deformable such that a first part of the covering device may be displaceable along the conveying direction, and a second part of the covering device may be displaceable at an angle to the conveying direction, in particular orthogonal, away from the component part. Thus, a space-saving covering device may be provided. If for example the second part of the covering device leaves the temperature-control zone, then the covering device may be deflected, for example over a deflection roller (or deflection pulley), such that the second part may no longer be aligned parallel to the conveying direction. Accordingly, space for moving in and out of the covering device may be saved along the conveying direction in the surrounding around the temperature-control zone.

According to a further exemplary embodiment, the covering device may consist of covering parts that may be connected in articulated manner (or hingedly) to each other. The covering parts may be formed for example rigid and not deformable. The covering parts may be connected with each other e.g. in an articulated manner (catenarianly, or like a chain), and thus deformable to each other via the hinges.

According to a further exemplary embodiment, the temperature-control zone controller may have at least one covering flap, wherein the covering flap may be arranged in the temperature-control zone. The covering flap may be rotatable to a first position, in which the temperature-control effect of the temperature-control zone may not be influenced, and may be rotatable to a second position, in which the temperature-control effect of the temperature-control zone may be reducible. The covering flap may consist for example of a temperature-insulating material. The covering flap may be arranged in particular between the temperature-control elements and the component part. The covering flap may be rotatable around a rotation axis in order to be rotated in the desired position.

In a first e.g. opened position, the covering flap may not hinder the temperature-control flow of a temperature-control fluid, which may flow through the according nozzles as temperature-control elements in the direction of the component part. In a second e.g. closed position, the covering flap may hinder the temperature-control flow of the temperature-control fluid, such that the temperature-control fluid may have no and/or only hardly a temperature-control effect on the component part in this area.

A plurality of covering flaps may be arranged along the conveying direction and/or transverse to the conveying direction. Herein, the temperature-control zone controller may be configured to control particular selected covering flaps, such that a first covering profile of opened covering flaps and a second covering profile of closed covering flaps may be adjusted variably, in order to thus possibly adjust the temperature-control effect of the component part more exactly and more flexibly.

According to a further exemplary embodiment, the temperature-control zone controller may have at least one covering lamella, which may extend in particular transverse and/or along the conveying direction. The covering lamella may be, in particular transverse to and/or in the conveying direction, movable to a first position, in which the temperature-control effect of the temperature-control zone may not be influenced, and may be movable to a second position, in which the temperature-control effect of the temperature-control zone may be reducible. The covering lamella may consist for example of a temperature-insulating material. The covering lamella may be movable and/or displaceable in particular along a translational movement direction. For example, the covering lamella may consist of a heat-resistant metal material. The covering lamella may have for example areas having an opening, wherein these opening areas may cover the temperature-control elements, such as for example the nozzles, in the first position of the covering lamella, such that the temperature-control effect of the temperature-control elements through the opening area may act on the component part. In the second position of the covering lamella, for example a metal area of the covering lamella may cover the temperature-control element, such that, in this second position, no and/or hardly a temperature-control effect may act on the component part.

According to a further exemplary embodiment, the temperature-control zone controller may have a plurality of covering lamellae, which may extend independently from each other transverse to and/or in the conveying direction. The covering lamellae may be arranged one after the other along the conveying direction or transverse to the conveying direction. Each one of the covering lamellae may be movable independently from each other to the first position, in particular by controlling the temperature-control zone controller, in which first position the temperature-control effect of the temperature-control zone may be not influenced, and may be movable to the second position, in which the temperature-control effect of the temperature-control zone may be reducible.

It is pointed out that the embodiments described herein represent only a limited selection of possible embodiment variants of the invention. Thus, it is possible to combine the features of individual embodiments with each other in a suitable manner, such that a plurality of different embodiments can be considered to be obviously disclosed for the skilled person with the embodiment variants that are explicit herein. In particular, some embodiments of the invention are described by device claims, and other embodiments of the invention are described by method claims. It will however become clear for the skilled person upon reading this application, that, unless it is stated explicitly differently, in addition to a combination of features, which belong to one type of invention object, also an arbitrary combination of features, which belong to different types of invention objects, is possible.

SHORT DESCRIPTION OF THE DRAWINGS

In the following, embodiment examples are described in more detail with reference to the appended drawings for a further explanation and a better understanding of the present invention. In the drawings.

DETAILED DESCRIPTION OF EXEMPLARY EMBODIMENTS

Figure 1:
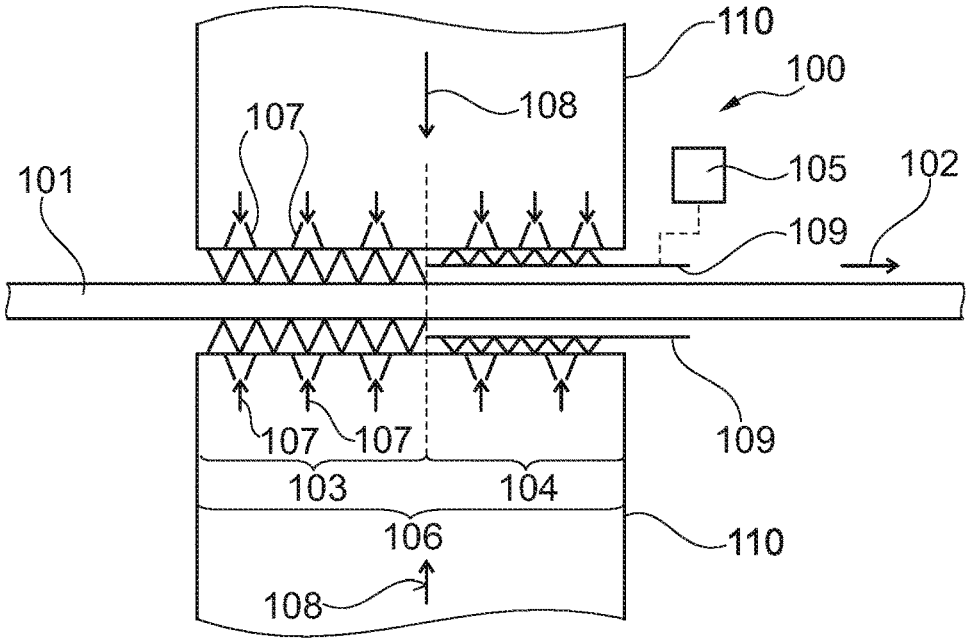
FIG. 1 shows a schematic representation of a device for temperature-controlling a component part, according to an exemplary embodiment of the present invention, according to which a covering device is employed.

Same or similar components in different figures are provided with same reference numerals. The representations in the drawings are schematical.

FIG. 1 shows a device 100 for temperature-controlling a component part 101. The device 100 may have a temperature-control zone 106, along which the component part 101 may be movable along a conveying direction 102. The temperature-control zone 106 may be configured to temperature-control at least a temperature control section 103 of the component part 101. Furthermore, the device 100 may have a temperature-control zone controller 105, which may be configured to cover a covering region 104 of the temperature-control zone 106 such that, in the covering region 104, a temperature-control effect from the temperature-control zone 106 on the temperature control section 103 of the component part 101 may be reducible. The temperature-control zone controller 105 may hereby be configured so as to adjust the size of the covering region 104.

The device 100 for temperature-controlling a component part 101 may in particular heat up or cool down the component part 101. In the embodiment in FIG. 1, the component part 101 may be a belt (or ribbon), in particular a metal belt, which may run through the temperature-control device 100 along a conveying direction 102. Thus, for example, the component part 101 may be conveyed initially along an oven device, in particular a continuous furnace. Further, to the oven device, for example the device 100 for temperature-controlling according to the invention may be arranged and may function for example as a high-speed (or high-rate) cooler, as is described above.

The component part 101 may be run through in the conveying direction 102 with a predetermined velocity. Furthermore, it may also be driven forwardly sequentially. Along the run-through through the device 100, the component part 101 may be cooled down with a predetermined cooling rate (or may be heated up with a predetermined heating rate). The device 100 may have a housing 110, which may have, in the conveying direction 102, an entrance and an exit, such that the component part 101 may be guided through the device 100. Within the device 100, temperature-control elements 107 may be arranged, which temperature-control the component part 101 with a desired temperature. Herein, the temperature-control elements 107 may for example represent nozzles, which may be flown through by a temperature-control fluid 108.

The region within the device 100, in which the component part 101 may be temperature-controlled, is referred to as the temperature-control zone 106. The temperature-control zone 106 of the device 100 may be configured such that at least a temperature control section 103 of the component part 101 may be temperature-controlled. In the case, in which the component part 101 may be larger than the temperature-control zone 106, for example because the component part may represent a metal belt, the temperature-control zone 106 may cover, respectively, only a section of the component part 101.

The temperature-control zone 106 may in particular be configured such that along the whole region thereof, a thermal effect, i.e. heat energy or a cooling effect, may act on the component part 101. In other words, temperature-control elements 107 may be conceived along the whole temperature-control zone 106, which elements may transfer the desired thermal effect on (or to) the component part 101.

The temperature-control zone controller 105 may be employed to cover a covering region 104 of the temperature-control zone 106. For example, the whole temperature-control zone 106 may be covered by the temperature-control zone controller 105, or no region of the temperature-control zone 106 may be covered in an in particular inactive state. The covering (or coverage) of the temperature-control zone 106 may be implemented for example with the elements described in detail further below, such as for example a covering device 109 (see the embodiment example of FIG. 1), covering flaps 301 (see the embodiment example of FIG. 3) or covering lamellae 401 (see the embodiment example of FIG. 4). The covering may be effected in particular between the temperature-control elements 107 within the temperature-control zone 106 and the component part 101 itself. Thus, in other words, the temperature-control zone controller 105 may cover a region 104 of the temperature-control zone 106 such that the thermal effect, which may be directed from the temperature-control zone 106 on (or to) the component part 101, may be covered and/or reduced. In this covering region 104 of the temperature-control zone 106, the component part 101 may thus not be temperature-controlled and/or reducedly temperature-controlled. The temperature-control zone controller 105 may have, for this purpose, furthermore in particular a control unit, for example a processor-controlled unit (for example a computer).

The temperature-control elements 107 may be for example nozzles, through which a temperature-control fluid 108 may be flowable in the direction towards the temperature control section 103 of the component part. The temperature-control fluid 108 may be for example gaseous or liquid.

The temperature-control elements 107 may be arranged along a row parallel to the conveying direction 102 or transverse to the conveying direction 102. In particular, a matrix consisting of rows of temperature-control elements 107 transverse and along the conveying direction 102 may form the temperature-control zone 106.

In the embodiment example in FIG. 1, the temperature-control zone controller 105 may have a covering device 109, wherein the covering device 109 may be movable within the temperature-control zone 106 along the conveying direction 102 and/or transverse to the conveying direction 102, in particular with respect to the temperature-control zone 106. In an exemplary embodiment, the covering device 109 may be a fabric (or cloth) material or a sheet plate (or iron sheeting) material.

As is described already at the beginning, the covering device 109 may be adjustable, at a housing 110 of the device 100, between the component part 101 and the temperature-control zone 106, such that a particular region 104 of the temperature-control zone 106 may be coverable, and thus a temperature-control effect from the temperature-control zone 106 on the component part 101 may be reducible and/or adjustable. The further the covering device 109 may be moved into the temperature-control zone 106, i.e. the more of the nozzle array 107 may be covered, the less area of the belt (component part 101) may be cooled, and/or the smaller may be the temperature control section 103 of the component part 101.

As is illustrated in FIG. 1, the device 100 may have temperature-control zones 106, which may be arranged opposite to the component part 101. Accordingly, for example, a covering device 109 may be moved in between the component part 101 and an upper part of the housing 110, and accordingly an upper temperature-control zone 106. Accordingly, for example, a further covering device 109 may be moved in between the component part 101 and a lower part of the housing 110 and accordingly a lower temperature-control zone 106. Correspondingly, the covering flaps 301 (see FIG. 3) and the covering lamellae 401 (see FIG. 4) may be arranged at both sides of the component part 101.

The covering devices 109, which may be movable into and out of the temperature-control zone 106 above and below the component part 101, may be moved uniformly and identically to each other. Furthermore, the temperature-control zone controller 105 may also control the covering devices 109 differently, such that for example the upper covering device 109 may be movable into the temperature-control zone 106 differently far than the lower covering device 109.

Figure 2:
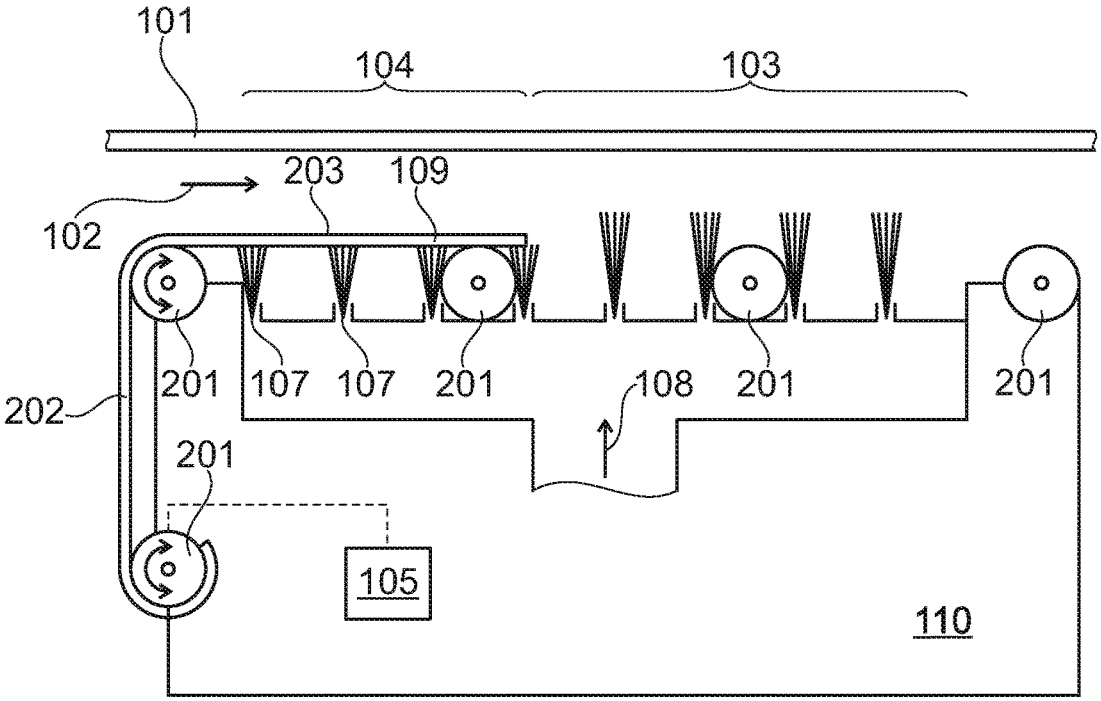
FIG. 2 shows a schematic representation of a device for temperature-controlling a component part according to an exemplary embodiment of the present invention, according to which a deformable covering device is employed.

FIG. 2 shows a further embodiment of the device 100. The device 100 of FIG. 2 may have the same construction as the device of FIG. 1. In addition, guide rollers 201 are illustrated. The covering device 109 may rest on at least one of the guide rollers 201. The guide rollers 201 may be drivable for example as a part of the temperature-control zone controller 105, in order to move the covering device 109 targetedly to a desired position along the temperature-control zone 106.

Furthermore, the covering device 109 may be formed deformably (e.g. formed as a covering curtain), such that a first part 203 of the covering device may be movable along the conveying direction 102, and a second part 202 of the covering device 109 may be movable at an angle to the conveying direction 103, in particular orthogonal, away from the component part 101. Thus, a space-saving covering device 109 may be provided. If for example the first part 203 of the covering device 109 leaves the temperature-control zone 106, then the covering device 109 may be deflected, for example via the deflection roller 201, such that the second part 202 may no longer be aligned parallel to the conveying direction 102.

Figure 3:
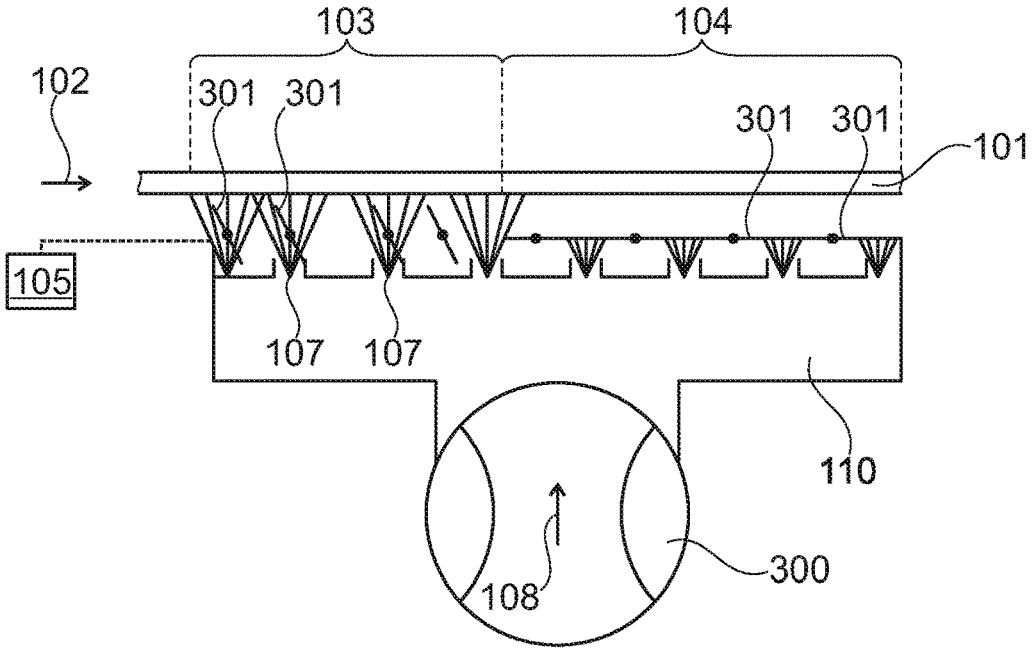
FIG. 3 shows a schematic representation of a device for temperature-controlling a component part according to an exemplary embodiment example of the present invention, according to which a covering flap is employed.

FIG. 3 shows a further embodiment of the device 100. The device 100 of FIG. 3 may have the same construction as the device 100 of FIG. 1, except that covering flaps 301 may be formed instead of a covering device 109.

The covering flaps 301 may be arranged in the temperature-control zone 106. A covering flap 301 may be rotatable to a first position (or posture), in which the temperature-control effect of the temperature-control zone 106 may not be influenced (temperature control section 103), and may be rotatable to a second position, in which the temperature-control effect of the temperature-control zone may be reducible (covering region 104). The covering flap 301 may be arranged in particular between the temperature-control elements 107 and the component part 101. The covering flap 301 may be rotatable around a rotation axis in order to be rotated to the desired position. In a first e.g. opened position, the covering flap 301 may let flow the temperature-control flow 108 of a temperature-control fluid, which may flow through according nozzles as the temperature-control element 107, in the direction towards the component part. In a second e.g. closed position, the covering flap 301 may hinder the temperature-control flow of the temperature-control fluid 108, such that the temperature-control fluid 108 may have no and/or hardly any temperature-control effect on the component part 101 in this region (covering region 104).

In FIG. 3, a blower 300 is furthermore illustrated, which may control the flow of the temperature-control fluid 108.

A plurality of covering flaps 301 may be arranged along the conveying direction 102 and/or transverse to the conveying direction 102. Herein, the temperature-control zone controller 105 may be configured to control particular selected covering flaps 301, such that a first covering profile of opened covering flaps 301 may be adjusted variably, and a second covering profile of closed covering flaps 301 may be adjusted variably, in order to thus possibly adjust the temperature-control effect of the component part 101 more precisely and more flexibly.

Figure 4:
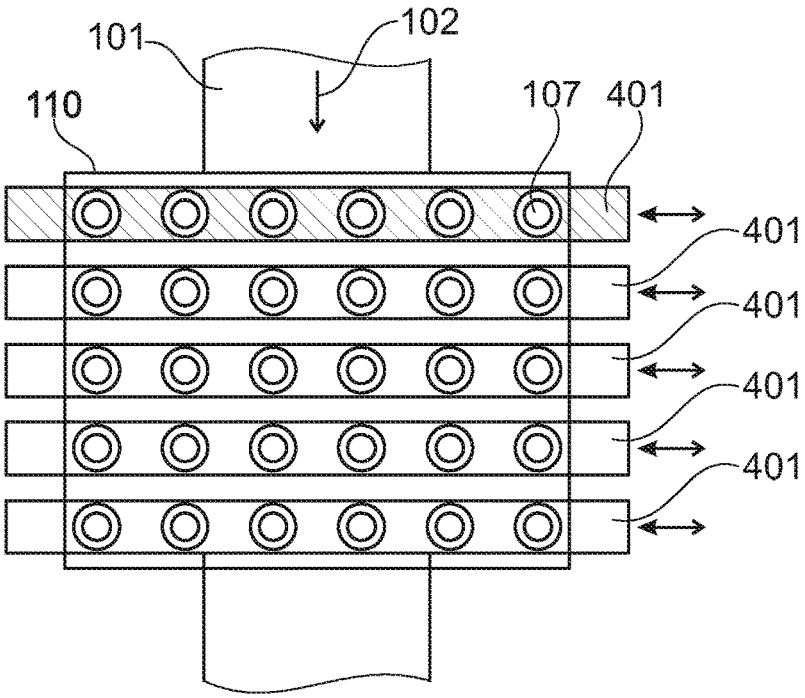
FIG. 4 shows a schematic representation of a device for temperature-controlling a component part according to an exemplary embodiment of the present invention, according to which a covering lamella is employed.

FIG. 4 shows a further embodiment of the device 100. The device 100 of FIG. 4 may have the same construction as the device 100 of FIG. 1, except that covering lamellae 401 may be formed instead of the covering device 109.

The covering lamellae 401 may extend transverse to the conveying direction 102. The covering lamella 401 may be movable, in particular transverse to and/or in the conveying direction 102, to a first position, in which the temperature-control effect of the temperature-control zone 106 may not be influenced, and may be movable to a second position, in which the temperature-control effect of the temperature-control zone 106 may be reducible. The covering lamella 401 may be movable and/or displaceable in particular along a translational movement direction. The covering lamella 401 may have areas having an opening, wherein these opening areas may cover the temperature-control elements 107, for example the nozzles, in the first position of the covering lamella 401, such that the temperature-control effect of the temperature-control elements 107 may act through the opening area on the component part 101. In the second position of the covering lamella 401, for example, a material region of the covering lamella 401 may cover the temperature-control element 107, such that no and/or only hardly any temperature-control effect may act on the component part 101 in this second position.

A plurality of covering lamellae 401 may be arranged beside each other for example along the conveying direction 102, and may extends independently from each other transverse to the conveying direction 102. Each one of the covering lamellae 401 may be movable independently from each other, in particular by the control of the temperature-control zone controller 105, to the first position, in which the temperature-control effect of the temperature-control zone 106 may not be influenced, and may be movable to the second position, in which the temperature-control effect of the temperature-control zone 106 may be reducible.

Supplementarily, it is noted that "having" (or "comprising") does not exclude other elements or steps, and that "a" or "an" does not exclude a plurality. Furthermore, it is noted that features or steps, which have been described with reference to one of the embodiment examples above, can also be used in combination with other features or steps of other embodiment examples described above. Reference numerals in the claims are not to be considered as a limitation.

LIST OF REFERENCE NUMERALS

100 device
101 component part
102 conveying direction
103 temperature control section
104 covering region
105 temperature-control zone controller
106 temperature-control zone
107 temperature-control element
108 temperature-control fluid

109 covering device
110 housing
201 guide roller
202 second one of the covering device
203 first one of the covering device
300 blower/compressor
301 covering flap
401 covering lamella

The invention claimed is:

1. A high speed cooler for temperature-controlling a metallic component part comprising:

a temperature-control zone, in which the metallic component part is continuously moved through along a conveying direction during a temperature controlling process, wherein the temperature-control zone is configured to temperature-control at least a temperature-control section of the metallic component part, a temperature-control zone controller, which is configured to cover a covering region of the temperature-control zone such that in the covering region a temperature-control effect from the temperature-control zone to the temperature-control section of the metallic component part is reducible, wherein the temperature-control zone controller variably adjusts the size of the covering region including when a section of the metallic component part shall be strongly cooled the size is made smaller, and when another section of the metallic component part shall hardly or not be cooled the size is enlarged; and a housing having in the conveying direction an entrance and an exit wherein the metallic component part is continuously guided through in the conveying direction with a predetermined velocity;

wherein the temperature-control zone has, along the conveying direction, a plurality of temperature-control elements that are located at a distance to each other;

wherein the temperature control elements are cooling elements to cool the metallic component part, and wherein the temperature control elements are nozzles.

2. The high speed cooler according to claim 1, wherein the temperature-control zone has, transverse to the conveying direction, a plurality of temperature-control elements that are located at a distance to each other.

3. The high speed cooler according to claim 1, wherein the temperature-control zone controller has a covering device, wherein the covering device is movable within the temperature-control zone along the conveying direction and/or transverse to the conveying direction.

4. The high speed cooler according to claim 3, wherein the covering device bears on at least one guide roller.

5. The high speed cooler according to claim 3, wherein the covering device being configured such that a first part of the covering device is displaceable along the conveying direction and a second part of the covering device is displaceable at an angle to the conveying device away from the metallic component part.

6. The high speed cooler according to claim 5, wherein the second part of the covering device is displaceable at an orthogonal angle to the conveying device away from the metallic component part.

7. The high speed cooler according to claim 3, wherein the covering device has a fabric material or a sheet plate material.

8. The high speed cooler according to claim 3, wherein the covering device consists of covering portions that are connected to each other in an articulated manner.

9. The high speed cooler according to claim 1, wherein the temperature-control zone controller has at least one covering flap, wherein the covering flap is arranged in the temperature-control zone, wherein the covering flap is pivotable to a first position, in which the temperature-control effect of the temperature-control zone is not influenced and is pivotable to a second position, in which the temperature-control effect of the temperature-control zone is reducible.

10. The high speed cooler according to claim 1, wherein the temperature-control zone controller has at least one covering lamella, wherein the covering lamella is displaceable to a first position, in which the temperature-control effect of the temperature-control zone is not influenced, and is displaceable to a second position, in which the temperature-control effect of the temperature-control zone is reducible.

11. The high speed cooler according to claim 10, wherein the temperature-control zone controller has a plurality of covering lamella, which extend independently from each other transverse to and/or in the conveying direction, wherein the covering lamella are arranged one after the other along the conveying direction or transverse to the conveying direction, wherein each of the covering lamella is displaceable independently from each other to the first position, in which the temperature-control effect of the temperature-control zone is not influenced, and is displaceable to the second position, in which the temperature-control effect of the temperature-control zone is reducible.

12. The high speed cooler according to claim 10, wherein in the covering lamella extends in at least one of the conveying direction or a direction transverse to the conveying direction.

13. The high speed cooler according to claim 1, wherein the temperature-control zone controller has a processor-controlled unit.

* * * * *